United States Patent [19]

Ohtaki et al.

[11] Patent Number: 4,671,238

[45] Date of Patent: Jun. 9, 1987

[54] AIR-FUEL RATIO CONTROL SYSTEM

[75] Inventors: Kiyoshi Ohtaki, Fuchu; Kazuo Hara, Musashino, both of Japan

[73] Assignee: Fuji Jukogyo Kabushiki Kaisha, Tokyo, Japan

[21] Appl. No.: 787,397

[22] Filed: Oct. 15, 1985

[30] Foreign Application Priority Data

Oct. 22, 1984 [JP] Japan ..... 59-222632

[51] Int. Cl.[4] ..... F02M 7/00

[52] U.S. Cl. ..... 123/438; 123/440

[58] Field of Search ..... 123/438, 440, 472, 480, 123/492, 493

[56] References Cited

U.S. PATENT DOCUMENTS

| | | | |
|---|---|---|---|
| 3,939,654 | 2/1976 | Creps | 123/440 |
| 4,027,477 | 6/1977 | Storey | 123/440 |
| 4,036,186 | 7/1977 | Hattori et al. | 123/438 |
| 4,046,118 | 9/1977 | Aono | 123/438 |
| 4,089,313 | 5/1978 | Asano et al. | 123/440 |
| 4,131,091 | 12/1978 | Asano et al. . | |
| 4,240,389 | 12/1980 | Shimazaki . | |
| 4,363,305 | 12/1982 | Ohgami et al. | 123/438 |
| 4,539,967 | 9/1985 | Nakajima et al. | 123/438 |
| 4,563,990 | 1/1986 | Kishida et al. | 123/438 |

*Primary Examiner*—Raymond A. Nelli

*Attorney, Agent, or Firm*—Martin A. Farber

[57] ABSTRACT

An air-fuel ratio control system for an internal combustion engine has an electromagnetic valve for correcting the air-fuel ratio of air-fuel mixture, an $O_2$ sensor for detecting oxygen concentration in exhaust gases, and a feedback control circuit including a pulse generating circuit for generating pulses, the duty ratio of which is dependent on the oxygen concentration. The system has an engine deceleration detecting circuit and a light load detecting circuit for producing a deciding signal. Pulses having a fixed duty ratio are applied to the electromagnetic valve in response to the deciding signal so as to enrich the air-fuel mixture at the deceleration when the throttle valve closes.

2 Claims, 6 Drawing Figures

AIR-FUEL RATIO CONTROL SYSTEM

BACKGROUND OF THE INVENTION

The present invention relates to an air-fuel ratio control system for an internal combustion engine, which system controls the air-fuel mixture to the stoichiometric air-fuel ratio, at which ratio a three-way catalyst acts most effectively.

In a known air-fuel ratio control system for a motor vehicle, the air-fuel ratio of the air-fuel mixture burned in the engine cylinders is detected as the oxygen concentration in the exhaust gases by means of an $O_2$ sensor provided in the exhaust system of the engine, and a decision is made dependent on the output signal from the $O_2$ sensor which indicates whether the air-fuel ratio is richer or leaner than the value corresponding to the stoichiometric air-fuel ratio for producing a control signal. The control signal is applied to a proportion and integration circuit (PI circuit), the output of which is changed to pulse form. The pulses operate an electromagnetic valve so as to control the amount of bleed air in the carburetor. The duty ratio of the pulses is changed in accordance with the output of the PI circuit for controlling the air-fuel ratio of the mixture. When the duty ratio of the pulses is reduced, the air-fuel mixture is enriched. Thus, the air-fuel ratio is controlled to the stoichiometric air-fuel ratio, at which ratio a three-way catalyst in the exhaust system acts most effectively.

On the other hand, generally the carburetor does not have a flat load chateristic. Namely, the carburetor supplies richer air-fuel mixture at light load, and supplies lean mixture at heavy load.

In addition, when the engine at heavy load is rapidly decelerated, high intake manifold vacuum occurs, and fuel adhering on the wall of the intake manifold is sucked into the cylinders together with the intake air at a high vacuum. Accordingly, the air-fuel mixture is temporarily enriched, increasing the oxygen concentration in the exhaust gases. The emission control system operates to increase the duty ratio (for example 80%) so as to dilute the rich mixture, which results in an extremely lean mixture supply. FIGS. 4(*a*) and (*b*) show an increase of the duty ratio and the lean air-fuel mixture by dotted lines. Under such a condition, if the engine is re-accelerated to a heavy load range (lean mixture supply range), the air-fuel mixture is more diluted. Accordingly, the driveability of the vehicle is very low in such driving conditions.

SUMMARY OF THE INVENTION

The object of the present invention is to provide a system which may prevent the extremely lean mixture supply at re-acceleration.

To this end, the system of the present invention is characterized by fixing the duty ratio at a predetermined value so as to enrich the mixture at deceleration from the heavy load state.

According to the present invention, there is provided an air-fuel ratio control system for an internal combustion engine having an induction passage, means for supplying air-fuel mixture to the engine, an electromagnetic valve for correcting the air-fuel ratio of the air-fuel mixture supplied by the supply means, an $O_2$ sensor for detecting the oxygen concentration in the exhaust gases, and a feedback control circuit including comparator means for comparing the output of the $O_2$ sensor with a reference value and for producing an output signal responsive to the comparison, pulse generating circuit means responsive to the output signal of the comparator means for generating pulses, the duty ratio of which is dependent on the output signal, the pulses being for driving the electromagnetic valve to correct the air-fuel ratio.

The system further comprises engine deceleration detecting means for detecting the beginning of deceleration of the engine and for producing a deceleration signal, light load detecting means responsive to a predetermined light load for producing a light load signal, deciding means responsive to the deceleration signal and the light load signal within a predetermined period for producing a deciding singal, correcting means responsive to the deciding signal for supplying pulses having a fixed duty ratio to the electromagnetic valve so as to enrich the air-fuel mixture.

The deciding means comprises a timer responsive to the deceleration signal for producing a timer signal with the predetermined signal, and gate means responsive to the timer signal and the light load signal for producing the deciding signal. The engine deceleration detecting means and the light load detecting means produce respective signals dependent on the vacuum in the induction passage.

The other objects and features of this invention will be apparently understood from the following description with reference to the accompanying drawings.

DETAILED DESCRIPTION OF THE PREFERRED EMBODIMENT

Figure 1:
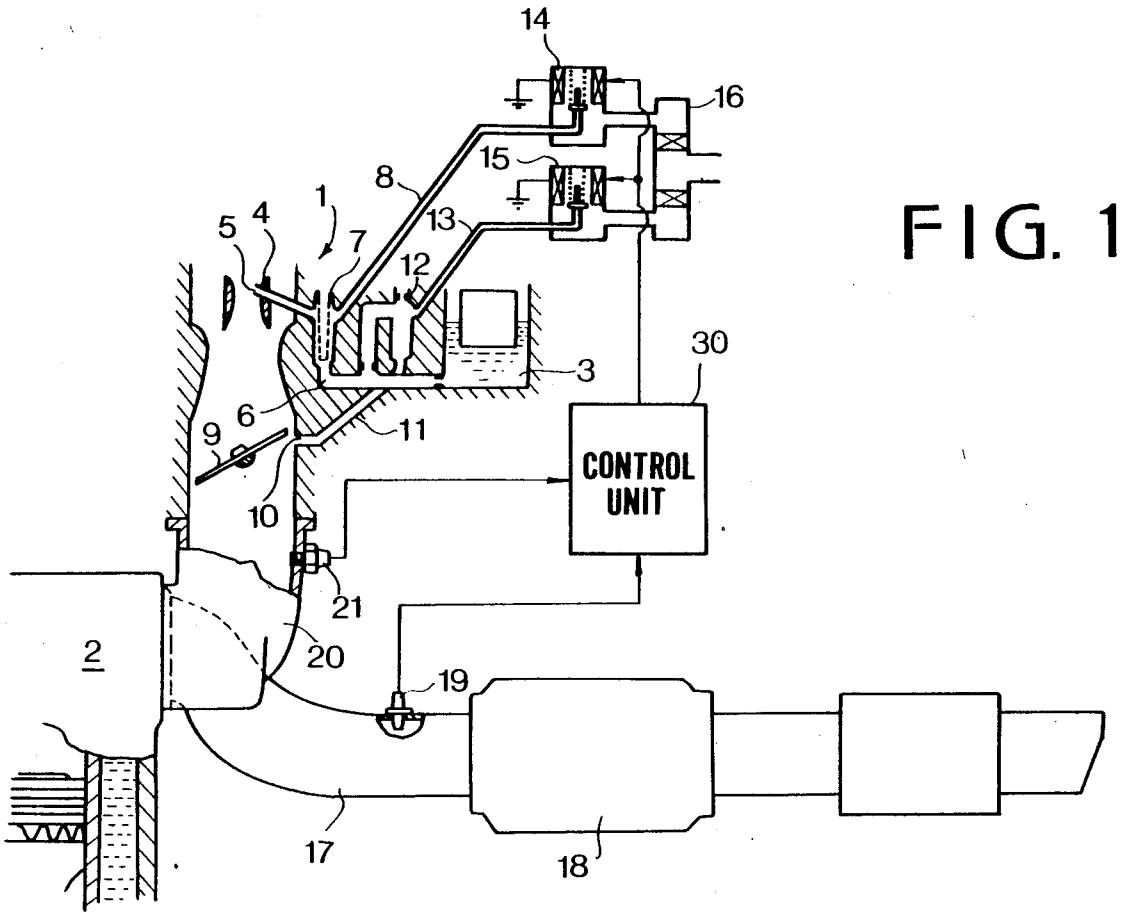
FIG. 1 is a schematic explanatory view of an air-fuel ratio control system according to the present invention.

Referring to FIG. 1, a carburetor 1 is provided adjacent to an intake manifold 20 of an internal combustion engine 2. A correcting air passage 8 communicates with an air-bleed 7 which is provided in a main fuel passage 6 between a float chamber 3 and a nozzle 5 in a venturi 4. Another correcting air passage 13 communicates with another air-bleed 12 which is provided in an idle fuel passage 11 which diverges from the main fuel passage 6 and extends to an idle port 10 in the vicinity of a throttle valve 9. These correcting air passages 8 and 13 communicate with on-off type electromagnetic valves 14, 15, the induction sides of which are in communication with the atmosphere through an air filter 16. A three-way catalytic converter 18 is provided in an exhaust pipe 17 downstream of the engine, and an $O_2$ sensor 19 is provided between the engine 2 and the converter 18 to detect the oxygen concentration of the exhaust gases when the air-fuel mixture is burned in the engine. A vacuum sensor 21 is provided in the intake manifold 20 downstream of the throttle valve 9.

The outputs of the $O_2$ sensor 19 and vacuum sensor 21 are sent to a control unit 30 which produces an output signal to actuate electromagnetic valves 14, 15 to open and close them at a duty ratio. Thus, either considerable air is supplied to the fuel system through the air correcting passages 8, 13 to produce a lean air-fuel mixture or only a small amount of air is supplied to the system so as to enrich the air-fuel mixture.

Figure 2:
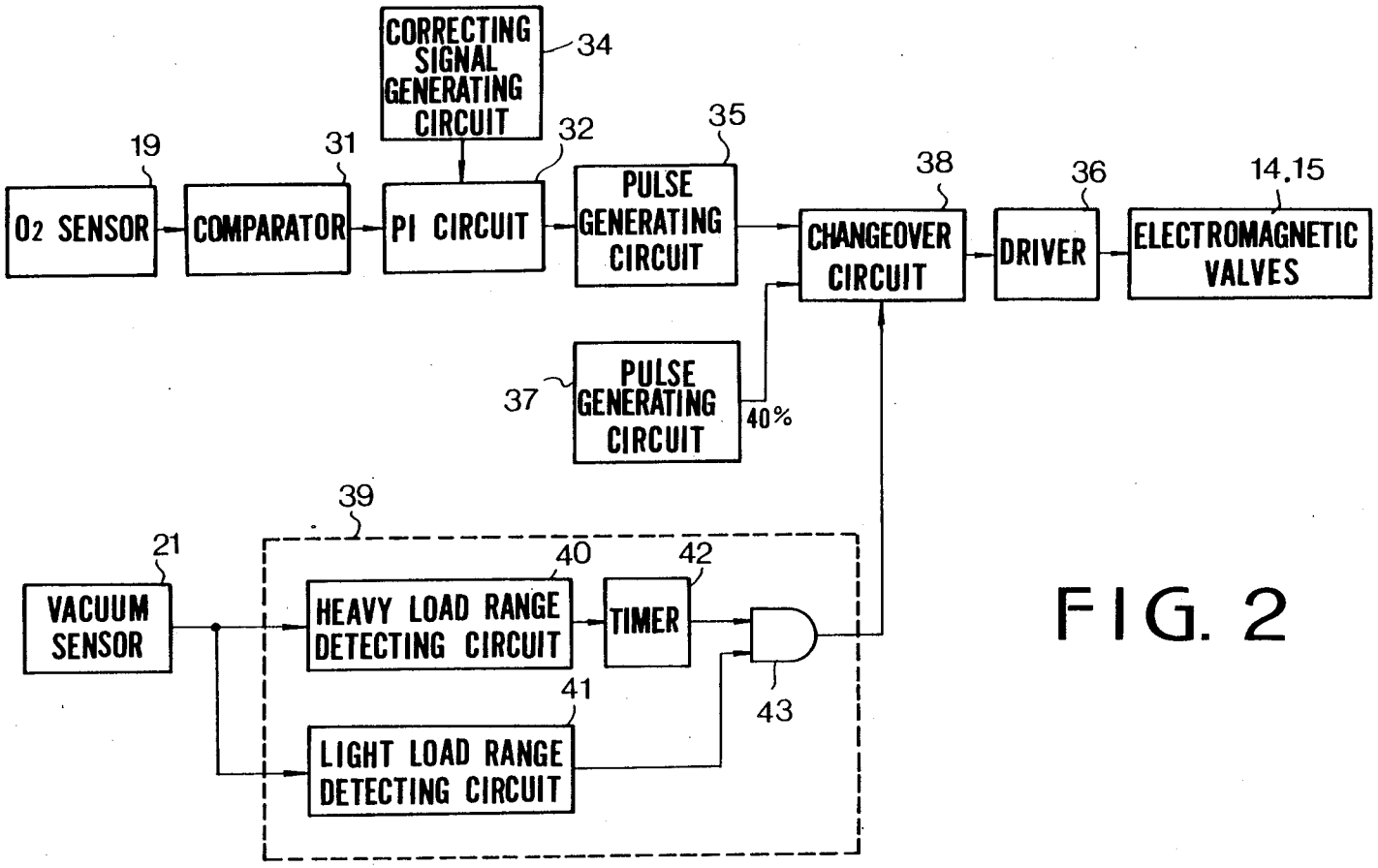
FIG. 2 is a block diagram of the electric control circuit of the present invention.

FIG. 2 shows the construction of the control unit 30 including a feedback control circuit. The output of the $O_2$ sensor 19 is applied to a PI (proportion and integration) circuit 32 through a comparator 31.

Generally, the air-fuel ratio varies cyclically with respect to the stoichiometric air-fuel ratio. Accordingly, the output of the $O_2$ sensor 19 has a waveform having a wavelength. The output is compared with a reference value at the comparator 31 which produces pulses dependent on the waveform. The pulses are applied to the PI circuit 32, so that the PI circuit produces an output signal having a sawshape waveform. The output of the PI circuit 32 is applied to a pulse generating circuit 35 which compares the output of the PI circuit 32 with triangular wave pulses and produces square wave pulses. The square wave pulses are supplied to the electromagnetic valves 14, 15 via a changeover circuit 38 and a driver 36 for operating the valves.

When a rich air-fuel mixture is detected, the pulse generating circuit 35 produces pulses having a large duty ratio so as to dilute the mixture. At a lean air-fuel mixture, the duty ratio of the pulses decreases to enrich the mixture.

The PI circuit 32 is supplied with various condition correcting signals from correcting signal generating circuit 34 in order to change the duty ratio in accordance with driving conditions. A fixed duty ratio pulse generating circuit 37 is provided which produces a pulse train having a fixed duty ratio (40%) for use for a re-acceleration state which the system of the invention concerns. The fixed duty ratio pulses are adapted to be supplied to electromagnetic valves 14, 15 through the changeover switch 38 and driver 36.

The changeover switch 38 is operated by an output of a deceleration detecting circuit 39. The circuit comprises a heavy load range detecting circuit 40 and a light load range detecting circuit 41, which are supplied with the output of the vacuum sensor 21. The heavy load range detecting circuit 40 produces a high level output when the vacuum is higher than a predetermined low value (for example −150 mmHg), which means the beginning of deceleration of the engine. The light load range detecting circuit 41 produces a high level output when the vacuum is higher than a predetermined high value (−500 mmHg), which means the throttle valve 9 is closed. The output of the heavy load range detecting circuit 40 is applied to a timer 42 which is responsive to the high level output of the circuit 40 to produce a high level output for a short period (10 sec.). The outputs of the timer 42 and the circuit 41 are applied to an AND gate 43. The output of AND gate 43 is applied to the changeover switch 38, so that the switch is operated to supply the fixed duty ratio pulses from the circuit 37 to the driver 36.

Figure 4:
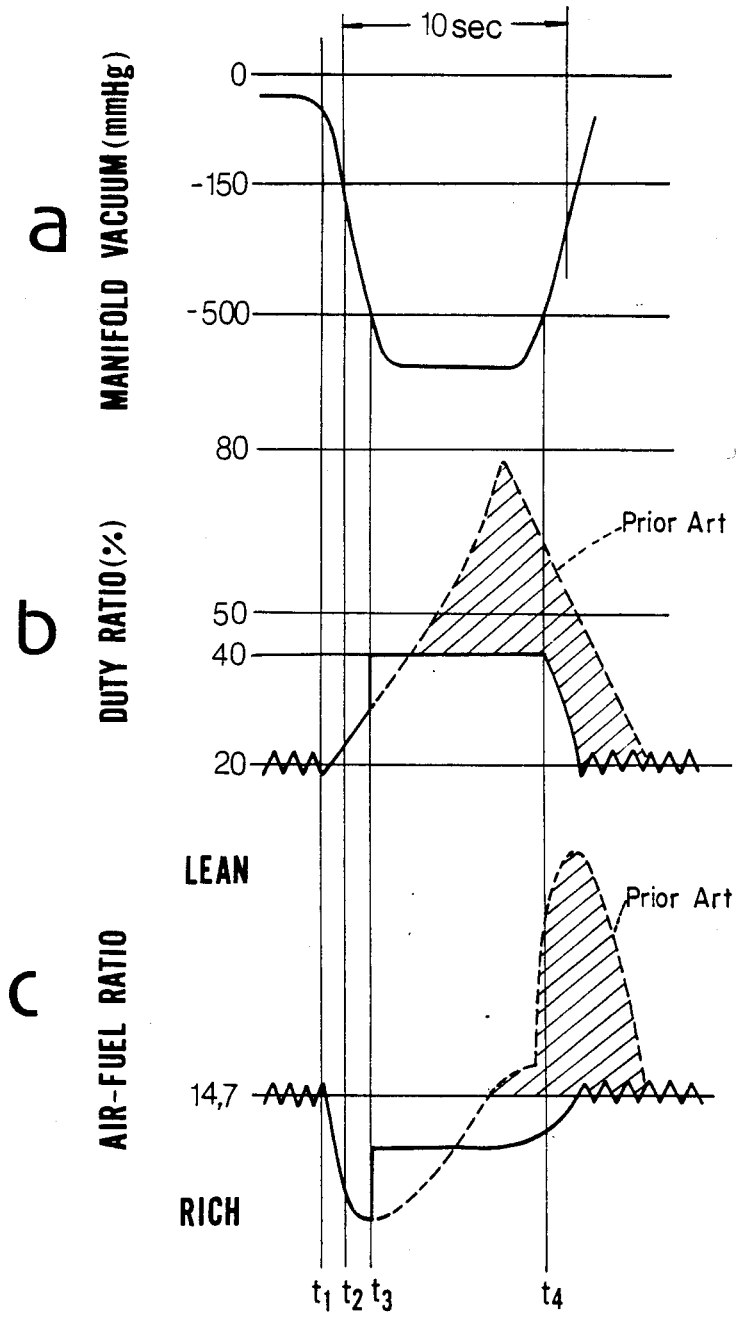
FIGS. 4(*a*) to 4(*c*) show intake manifold vacuum, duty ratio and air-fuel ratio at transient states of an engine.

In operation, when lean air-fuel mixture is detected, pulses having small duty ratios are produced from the circuit 35. Thus, the air-fuel mixture is enriched. When the manifold vacuum is lower than −150 mmHg at heavy load, the duty ratio is set about 20% as shown in FIG. 4(*b*) before time $t_1$, and the air-fuel ratio is kept at stoichiometric air-fuel ratio 14.7 as shown in FIG. 4(*c*). The output of the detecting circuit 40 is at a low level, and hence the timer 42 produces a low level output. At a time $t_1$, the throttle valve 9 begins to close to decelerate the engine, so that manifold vacuum rises. When the vacuum rises above −150 mmHg at $t_2$, the level of the output of timer 42 becomes high and the level is held for 10 seconds. During these 10 seoonds, when the vacuum rises above −500 mmHg at $t_3$, the detecting circuit 41 produces a high level output which causes the output of AND gate 43 to go to a high level to operate the changeover switch 38. Thus, the pulses having a duty ratio 40% are supplied to the electromagnetic valves 14, 15 through the changeover switch 38 and the driver 36, so that the air-fuel ratio is prevented from being diluted as shown by a solid line in FIG. 4(*c*). When the engine is re-accelerated at $t_4$ and the vacuum becomes lower than −500 mmHg, the output of the detecting circuit 41 goes to a low level, causing the output of the AND gate 43 to go to a low level. Accordingly, the system returns to the feedback control system. Since the air-fuel mixture is held rich, the air-fuel ratio is quickly controlled to the stoichiometric air-fuel ratio.

Figure 3:
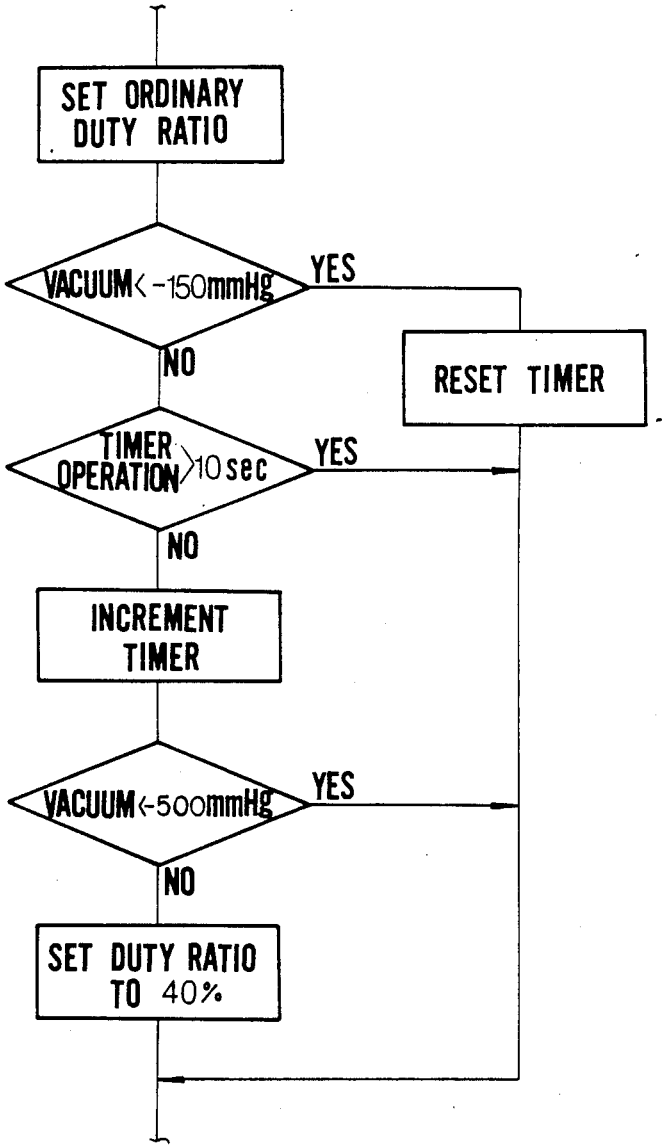
FIG. 3 shows a flowchart showing the operation of another embodiment of the present invention.

FIG. 3 shows the operation of another embodiment of the system which is composed by a microcomputer system.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. In an air-fuel ratio control system for an internal combustion engine having an induction passage, a throttle valve provided in the induction passage, means for supplying air-fuel mixture to the engine, an electromagnetic valve for correcting the air-fuel ratio fo the air-fuel mixture supplied by the supplying means, an $O_2$ sensor for detecting oxygen concentration in exhaust gases from the engine, and a feedback control circuit including comparator means for comparing the output of the $O_2$ sensor with a reference value for producing a first output signal responsive to the comparison, pulse generating circuit means responsive to the first output signal of the comparator means for generating pulses having a duty ratio dependent on the first output signal, the pulses for driving the electromagnetic valve to correct the air-fuel ratio, the improvement comprising:

a vacuum sensor provided in the induction passage downstream of the throttle valve so as to produce a second output signal dependent on vacuum in the induction passage;

heavy load range detecting means responsive to the second output signal when the vacuum is higher than a predetermined low value at a beginning of deceleration of the engine for producing deceleration signal;

light load detecting means responsive to the second output signal when the vacuum is higher than a predetermined high value at closing of the throttle valve for producing a light load signal, said high value is greater than said low value;

timer means responsive to the deceleration signal for producing a timer signal for a set period;

gate means responsive to the timer signal and the light load signal for producing a deciding signal;

correcting means responsive to the deciding signal for supplying pulses having a fixed duty ratio to the electromagnetic valve so as to enrich the air-fuel mixture.

2. In an air-fuel ratio control system according to claim 1, wherein said gate means is an AND gate.

* * * * *